United States Patent [19]

Beavitt

[11] 4,019,163

[45] Apr. 19, 1977

[54] REED CONTACT UNIT

[75] Inventor: Alan R. Beavitt, Towcester, England

[73] Assignee: Square D Company, Park Ridge, Ill.

[22] Filed: Feb. 5, 1976

[21] Appl. No.: 655,589

Related U.S. Application Data

[63] Continuation of Ser. No. 557,210, March 10, 1975, abandoned.

[52] U.S. Cl. ..... 335/154; 335/196

[51] Int. Cl.[2] ..... H01H 51/28

[58] Field of Search ..... 335/154, 153, 152, 151, 335/196

[56] References Cited

UNITED STATES PATENTS 3,665,349 5/1972 Beavitt ..... 335/154

*Primary Examiner*—Harold Broome

*Attorney, Agent, or Firm*—Harold J. Rathbun; James S. Pristelski

[57] ABSTRACT

The reed contact unit comprises a pair of aligned members of magnetizable and electrically conductive material spaced apart endwise from each other with a fillet of non-magnetic electrically conductive material inserted between the spaced ends of the members. The upper surfaces of the members and the fillet are coplanar. An electrically conductive cantilever carries an electrically conductive and magnetizable armature at its free end overlying the fillet and the adjacent ends of the members. Upon magnetization of the members, a contact surface of the armature contacts the members to complete an electric circuit between the cantilever and the members. The members and the cantilever are mounted within a hermetically sealed enclosure.

7 Claims, 5 Drawing Figures

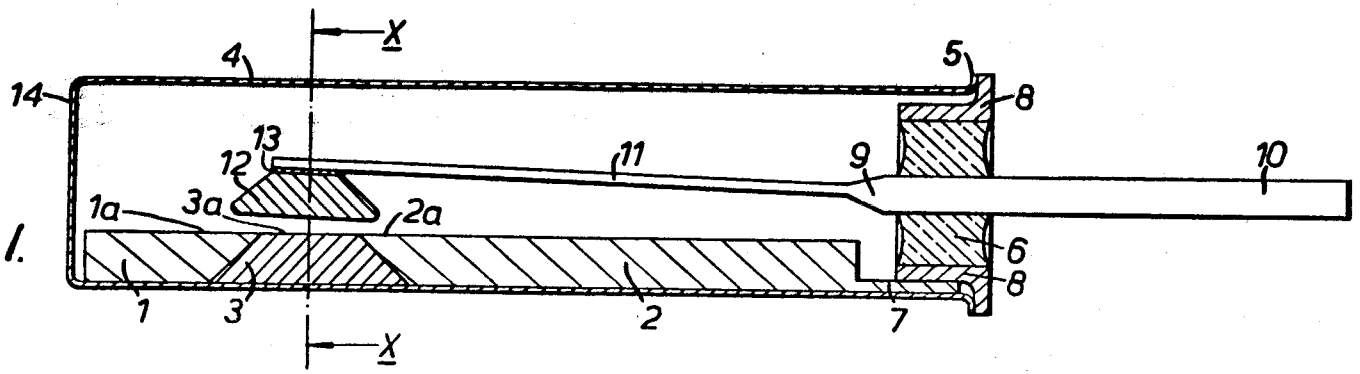
FIG. 1.
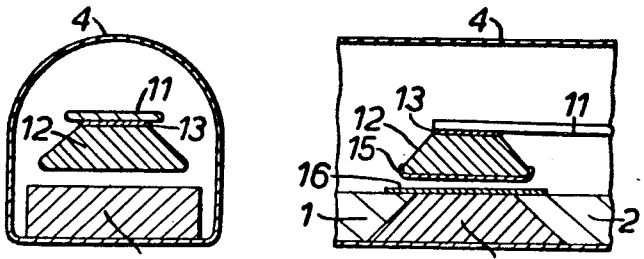
FIG. 2.
FIG. 3.
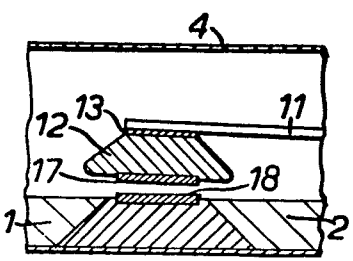
FIG. 4.
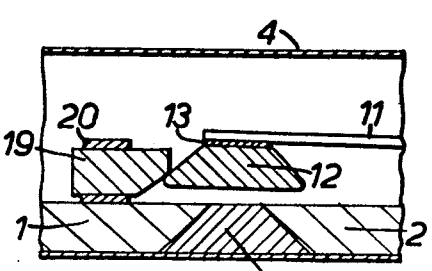
FIG. 5.

REED CONTACT UNIT

This is a continuation of application Ser. No. 557,210, filed Mar. 10, 1975 and now abandoned.

BACKGROUND OF THE INVENTION

The invention relates to electrical reed switches, and more particularly to a reed switch carrying a contact-making magnetic armature at the free end of a cantilever.

This invention is an improved reed switch of the general type disclosed in U.S. Pat. No. 3,665,349 which issued on May 23, 1972.

In the switch disclosed in the patent, a pair of longitudinally spaced members of magnetizable material constitute an electrical contact of a switch and a fillet of non-magnetic conducting material is positioned between the adjacent ends of the members. The upper surface of the fillet is positioned below the upper surface of the members. An armature mounted on a cantilever is arranged to engage the ends of the members upon the creation of a magnetic field thereby to complete a circuit directly between the members and the armature there being no interposition of a more suitable contact material. Also the prior switch has no stop means for the cantilever.

SUMMARY OF THE INVENTION

The invention provides a reed contact unit which includes a pair of aligned members of a magnetizable and electrically conductive material spaced apart endwise from each other; a fillet of a non-magnetic electrically conductive material inserted between the spaced ends of the members, the surfaces of the fillet and the members being co-planar in order to provide for the contact unit a stationary contact having a continuous contact surface; a resilient cantilever mounted so as to be electrically independent of the members; a magnetizable armature secured to the free end of the cantilever and overlying the stationary contact surface, attraction of the armature to the members upon magnetization of the members causing a contact surface of the armature to make contact with the stationary contact surface and complete an electrical circuit through the cantilever to the members. The members are preferably asymmetrical in order to provide a low volume contact unit.

In one arrangement for the reed contact unit according to the invention the ends of the members are contiguous with the fillet may be angled away from the stationary contact surface so that the width of the fillet therebetween is a minimum at the contact surface and the members may be of rectangular cross-section.

In another arrangement for the reed contact unit according to the invention a non-magnetic stop member may be provided for minimizing armature oscillations after the electrical circuit is broken, the stop member being electrically independent of the members. Conveniently, the stop member may be secured to one of the members which may have a clip attached thereto for securing the stop member in position, the clip or the stop member being of an electrically insulating material.

In another arrangement for the reed contact unit according to the invention the contact surfaces of the armature and the stationary contact may each be either coated with a layer of an electric contact material or have a disc of an electric contact material secured thereto. Conveniently, the contact discs may each be located and secured within a recess in the associated contact surface.

In a further arrangement for the reed contact unit according to the invention the cantilever is spaced apart from and overlies one of the members, and the fixed end of the cantilever may be retained in an insulating plug which closes one end of an envelope of the contact unit. Conveniently, the envelope is D-shaped in cross-section.

A preferred arrangement for the reed contact unit according to the invention includes a hollow enlongated housing member which is open at one end and D-shaped in cross-section; a pair of aligned and longitudinally spaced asymmetrical members of a magnetizable and electrically conductive material which are positioned in the housing member in electrical contact therewith and which have a non-magnetic and electrically conductive fillet inserted between the spaced ends thereof, the surfaces of the fillet and the members being co-planar and forming a stationary electrical contact for the contact unit; a magnetizable armature movable into and out of contact with the stationary contact; a resilient cantilever on which the armature is mounted, the cantilever forming an electrical contact terminal for the contact unit and being mounted in a glass-to-metal seal which is located in, and seals, the open end of the housing member and which is secured to one of the said members; and a non-magnetic stop member for minimizing armature oscillations, the stop member being secured to, and electrically isolated from, the other one of the members.

BRIEF DESCRIPTION OF THE DRAWINGS

The foregoing and other features according to the invention will be better understood from the following description with reference to the drawings in which:

FIG. 1 diagrammatically illustrates in a cross-sectional side elevation one arrangement for the reed contact unit according to the invention.

FIG. 2 diagrammatically illustrates the reed contact unit arrangement of FIG. 1 in a cross-sectional elevation on the line 'X—X', and FIGS. 3 to 5 diagrammatically illustrate, in part, cross-sectional side elevations of further arrangements for the reed contact unit according to the invention.

DISCUSSION OF PREFERRED EMBODIMENTS

The reed contact unit diagrammatically illustrated in FIGS. 1 and 2 of the drawings includes two aligned members 1 and 2 which are of a magnetizable and electrically conductive material and which are of rectangular cross-section. The members 1 and 2, which are preferably of iron, are spaced apart endwise from each other and have a fillet 3 of a non-magnetic electrically conductive material such as copper inserted between the spaced ends. The surface 3*a* of the fillet and the surfaces 1*a* and 2*a* respectively of the members 1 and 2 are co-planar in order to provide for the contact unit a stationary contact having a continuous and relatively large contact surface area.

The members 1 and 2 are preferably asymmetrical in order to provide a contact unit of a relatively small volume.

The ends of the members 1 and 2 that are contiguous with the fillet 3 are preferably chamfered in order to reduce the flux leakage therebetween, the chamfering being such that the ends of the members are angled away from the stationary contact surface so that the width of the fillet 3 is a minimum at the contact surface.

The members 1 and 2 are housed within a metal tube 4, typically of a copper-nickel alloy, which is open at one end 5 and which is preferably D-shaped in cross-section. The open end 5 of the tube 4 is hermetically closed by means of a glass-to-metal seal 6, a reduced section 7 of the member 2 being situated between the tube 4 and an outer metallic part 8 of the glass-to-metal seal 6. The reduced section 7 is welded to the metallic part 8 which is also welded around its periphery to the open end 5 of the tube 4 in order to provide a sealed enclosure for the contact unit. The tube 4 in association with the members 1 and 2 and the fillet 3 form one electrical contact for the reed contact unit.

In the center of the glass-to-metal seal 6 is fixedly secured a metallic member 9, typically of a nickel-iron alloy, which is arranged to pass through the center of the seal, one end 10 of the member 9 forming an electrical contact terminal for the reed contact unit while a section 11 at the other end thereof is flattened in order to form a cantilever. The cantilever section 11 of the member 9 carries at the extreme end thereof a magnetizable armature 12, typically of iron and conveniently stamped out of the iron strip from which the iron members 1 and 2 are formed. The nickel iron alloy cantilever 11 is in a work hardened condition and the armature 12 is chamfered in order to reduce the effective mass and to facilitate the provision of a compact structure for the reed contact unit.

The armature 12 is welded or otherwise secured to the cantilever 11 as indicated by the layer 13, the thickness of the layer 13 being adjusted during the production of the contact unit in order to provide, with the cantilever 11 in its normal position, a desired air gap between the members 1 and 2 and the armature 12. The air gap is such that when a longitudinal magnetic field (not illustrated) is brought into the vicinity of the members 1 and 2, they become polarized and cause the armature 12 to be attracted towards them, so that the armature 12 makes bridging contact with the members 1 and 2 and thereby contact with the fillet 3. The use of the fillet 3, therefore, increases the effective contact area for the armature 12 and thereby increases contact life because of the increase in the contact area available for erosion.

Since the members 1 and 2 are in contact with the metal tube 4 they are electrically connected, and the effect of the application of the magnetic field is to cause an electrical connection to be made between the members 1 and 2 and the armature 12 and thus between the electrical contact constituted by the tube 4 and the electrical contact constituted by the end 10 of the member 9 which extends from the end 5 of the tube 4. An electrical contact terminal or lead for the tube 4 may be provided at the closed end 14 thereof. Thus, the electrical circuit is from the tube 4, members 1 and 2, armature 12 and member 9 while the magnetic circuit is between the member 1, the armature 12 and the member 2.

In order to reduce contact resistance and the possibility of welding on contact closure, the contact surfaces of the armature 12 and the stationary contact can, as is illustrated in FIG. 3 of the drawings, be respectively coated with layers 15 and 16 of a contact material such as tungsten. The contact material thicknesses that can be used for the layers 15 and 16 are limited by magnetic considerations but the use of the fillet 3 ensures that a relatively large area of contact material is available for erosion and, therefore, the contact life is increased in comparison to known devices.

In a further arrangement for the reed contact unit according to the invention, the layers 15 and 16 of FIG. 3 can, as is illustrated in FIG. 4, be respectively replaced by discs 17 and 18 of a contact material such as tungsten. The discs 17 and 18 are each preferably located and secured within a recess in the associated contact surface. The area of the respective contact surfaces of the members 1 and 2 and the armature 12 not covered by the discs 17 and 18 must be sufficient to achieve the desired magnetic properties for the contact unit, i.e. the magnetic circuit between the member 1, the armature 12 and the member 2 must be such that efficient operation of the contact unit can be achieved. Also, the depth of each of the recesses for the discs 17 and 18 and the disc thicknesses must be selected so that the resulting air gaps between the armature 12 and the members 1 and 2 do not adversely affect the reluctance of the magnetic circuit of the contact unit.

In order to minimize armature oscillations after the electrical connection is broken, i.e. after removal of the magnetic field, any one of the reed contact units described above can, as is illustrated in FIG. 5, include a non-magnetic stop member 19 which is preferably secured to, but electrically isolated from, the member 1. The member 1 has a clip 20 attached thereto for securing the stop member 19 in position. The stop member 19 and/or the clip 20 can be of an electrically insulating material. In a preferred arrangement the stop member 19 is of a non-magnetic and electrically insulating ceramic material.

It can therefore be seen from the foregoing that the use of a fillet 3 increases the area of the contact surface that is available for erosion and therefore increases contact life and that unlike a conventional reed switch wherein the contact blades conduct flux to the contact region as well as providing for electrical connection and retractile force, the construction of the reed contact unit according to the present invention is such that the retractile force for the armature and the electrical connection are provided for by a member 9 which does not need to conduct flux. This has the advantage that a better spring material can be used for the member 9. Also, the cantilever section 11 can be of a relatively smaller length and cross-section and these features in combination with asymmetrical members 1 and 2 enable a contact unit of a relatively small volume to be produced. Another advantage of the reed contact unit according to the invention is that the armature 12 where most of the effective mass of the contact unit is concentrated, only needs to conduct flux across the fillet 3, the ratio of operating force to effective mass being, therefore, much larger than that of the conventional reed switch. This advantage allows shorter contact bounce periods and improves the shock and vibration resistance of the contact unit.

Also the use of a stop member 19 ensures that armature oscillations are minimized.

A further advantage of the reed contact unit according to the invention is that the use of a metal tube 4 and a compression glass-to-metal seal 6 provides a very robust structure which is reasonably inexpensive to produce and capable of handling high currents, for example, 5 amperes at 240 volts a.c.

We claim:

1. A reed contact unit comprising a pair of aligned members of magnetizable and electrically conductive materials spaced apart endwise from each other;

a fillet of a non-magnetic electrically conductive material inserted between the spaced ends of the members with a surface of the fillet and of each of the members co-planar to thereby provide a continuous contact surface;

a resilient cantilever mounted to be electrically independent of the members;

a magnetizable armature secured to the free end of the cantilever and positioned to move and make contact with the contact surface and complete an electrical circuit through the cantilever to the members upon magnetization of the members;

a non-magnetic stop member positioned to limit movement of the armature upon breaking of the electrical circuit to thereby minimize oscillation with the stop member electrically insulated from the members.

2. A reed contact unit according to claim 1 wherein the stop member is secured to one of the members.

3. A reed contact unit according to claim 2 wherein the stop member is secured in position by a clip attached to one of the members.

4. A reed contact unit according to claim 3 wherein the clip and the stop member are of an electrically insulating material.

5. A reed contact unit according to claim 1 wherein the contact surfaces of the armature and the continuous contact surface are each coated with a layer of an electrical contact material.

6. A reed contact unit according to claim 1 wherein the contact surfaces of the armature and the continuous contact surface each have a disc of an electrical contact material secured thereto.

7. A reed contact unit according to claim 6 wherein the contact discs are each located and secured within a recess in the associated contact surface.

* * * * *